US011286138B2

(12) United States Patent
Yu et al.

(10) Patent No.: US 11,286,138 B2
(45) Date of Patent: Mar. 29, 2022

(54) WINCH AND BRAKE UNIT WITH SLIDING BLOCKS

(71) Applicant: Zhejiang Runva Mechanical & Electrical Co., Ltd, Zhejiang (CN)

(72) Inventors: Zhilin Yu, Zhejiang (CN); Linji Dai, Zhejiang (CN); Xiaobin Zhang, Zhejiang (CN); Ling Ye, Zhejiang (CN)

(73) Assignee: Zhejiang Runva Mechanical & Electrical Co., Ltd, Jinhua (CN)

( * ) Notice: Subject to any disclaimer, the term of this patent is extended or adjusted under 35 U.S.C. 154(b) by 89 days.

(21) Appl. No.: 17/006,939

(22) Filed: Aug. 31, 2020

(65) Prior Publication Data

US 2021/0139298 A1 May 13, 2021

Related U.S. Application Data

(63) Continuation of application No. PCT/CN2019/119782, filed on Nov. 20, 2019.

(30) Foreign Application Priority Data

Nov. 7, 2019 (CN) ..... 201911079095.X

(51) Int. Cl.

| | |
|---|---|
| ***B66D 1/22*** | (2006.01) |
| ***B66D 1/14*** | (2006.01) |
| ***B66D 1/48*** | (2006.01) |

(52) U.S. Cl.

CPC ..... *B66D 1/225* (2013.01); *B66D 1/14* (2013.01); *B66D 1/485* (2013.01)

(58) Field of Classification Search

CPC ... B66D 1/12; B66D 1/14; B66D 1/16; B66D 1/22; B66D 1/225; B66D 1/40; B66D 1/48; B66D 1/485

See application file for complete search history.

(56) References Cited

U.S. PATENT DOCUMENTS 551,488 A * 12/1895 Christiansen ..... B66D 1/50 254/272
1,204,597 A * 11/1916 Skofsrud ..... B65H 19/2215 242/523.1
1,362,373 A * 12/1920 Turney ..... B66D 1/14 254/305
1,593,595 A * 7/1926 Peters ..... B66D 1/26 254/298

(Continued)

FOREIGN PATENT DOCUMENTS

CN 201261697 Y 6/2009

*Primary Examiner* — Michael E Gallion

(57) ABSTRACT

A winch includes a coupling A, a coupling B, a rectangular spring, a gear wheel, a gear rack, a friction ring, and a transmission shaft, etc. By increasing the distance between the adjacent internal teeth of the two-stage planet carrier, it ensures that the three-stage sun gear can be smoothly inserted into the two-stage planet carrier even if the elasticity of spring A is reduced, such that the engagement width between the three-stage sun gear and the two-stage planet carrier can reach the normal requirements. With the design of sliding gear ring and spring C, it can greatly reduce the phenomenon of mis-engagement when the external teeth of the three-stage sun gear enter the internal teeth spacing of the two-stage planet carrier, protect the teeth integrity of the three-stage sun gear and the two-stage planet carrier.

9 Claims, 9 Drawing Sheets

(56) References Cited

U.S. PATENT DOCUMENTS 1,609,074 A * 11/1926 Evans ..... B66D 1/225 475/290
1,849,213 A * 3/1932 Zetterlund ..... B66D 1/16 74/378
1,977,447 A * 10/1934 Lower ..... B66D 1/14 254/328
2,531,668 A * 11/1950 Briggs ..... B66D 1/14 254/347
3,319,492 A * 5/1967 Magnuson ..... B66D 5/12 475/12
3,744,759 A * 7/1973 Jennings ..... B66D 5/00 254/378
3,766,795 A * 10/1973 Priest ..... B66D 1/14 74/405
3,799,005 A * 3/1974 Koehler ..... B66D 1/225 475/12
4,118,013 A * 10/1978 Christison ..... B66D 5/14 192/223.2
4,265,142 A * 5/1981 Watanabe ..... F16H 3/40 242/350
4,408,746 A * 10/1983 Marsch ..... B66D 1/22 188/170
4,461,460 A * 7/1984 Telford ..... B66D 1/22 188/337
5,482,255 A * 1/1996 Daschel ..... B66D 5/12 254/378
7,270,312 B1 * 9/2007 Phipps ..... B66D 1/22 254/278
7,703,751 B2 * 4/2010 Elliott ..... F16D 41/10 254/344
7,789,375 B2 * 9/2010 Ying ..... B66D 1/22 254/344
8,434,742 B2 * 5/2013 Akhavein ..... B66D 1/22 254/344
9,194,460 B2 * 11/2015 Jun ..... F16H 1/36
10,131,524 B2 * 11/2018 Wilkins ..... B66D 1/04
2003/0151037 A1 * 8/2003 O'Fallon ..... B66D 1/16 254/344
2009/0114892 A1 * 5/2009 Lesko ..... B66D 1/22 254/342
2010/0065799 A1 * 3/2010 Zhou ..... B66D 1/22 254/344
2010/0127228 A1 * 5/2010 Xie ..... B66D 5/14 254/346
2012/0065018 A1 * 3/2012 Wilkins ..... F16H 1/32 475/162
2013/0056694 A1 * 3/2013 Wilkins ..... B66D 5/00 254/342
2016/0130121 A1 * 5/2016 Miller ..... B66D 1/225 254/344

* cited by examiner

WINCH AND BRAKE UNIT WITH SLIDING BLOCKS

CROSS REFERENCE TO RELATED APPLICATIONS

The present application is a Continuation Application of PCT Application No. PCT/CN2019/119782 filed on Nov. 20, 2019, which claims the benefit of Chinese Patent Application No. 201911079095.X filed on Nov. 7, 2019, the contents of which are incorporated herein by reference in their entirety.

FIELD OF THE INVENTION

The present invention relates to the general technical field of winch, and specifically relates to a winch.

BACKGROUND

At present, in the current winches, the principle of the power connection or clutch between the deceleration component and the intermediate transmission shaft in the winch is to realize the clutch by changing the engagement relationship between a three-stage sun gear and a two-stage planet carrier. When the three-stage sun gear and the two-stage planet carrier are switched from a separation state to a reunion state, the three-stage sun gear cannot enter the two-stage planet carrier to produce engagement; in this case, the twisted rope needs to be manually pulled to rotate the drum, so that the drum can drive the three-stage sun gear to rotate a certain angle by the three-stage planet carrier and the three-stage planetary gear, and the three-stage sun gear can enter the two-stage planet carrier to produce engagement. However, when the above operation is improper or the rope pulling is forgotten and the motor is energized, the three-stage sun gear quickly enters the two-stage planet carrier to produce engagement, and the speed of the three-stage sun gear is related to the spring elasticity at the coupling. When the spring at the coupling becomes weak due to long-term use, the speed of the three-stage sun gear entering the two-stage planet carrier will slow down. At this time, when the internal teeth of the two-stage planet carrier are in contact with the three-stage sun gear external teeth and start transmission, it is very likely that the three-stage sun gear has not been inserted appropriately. The friction is generated due to the pressure of teeth engagement between the three-stage sun gear and the two-stage planet carrier during the transmission process. The inadequate force of the three-stage sun gear inserted into the two-stage planet carrier will inevitably lead to insufficient width of engagement generated between the three-stage sun gear and the two-stage planet carrier. If such state lasts for a long time, the teeth of the three-stage sun gear and the two-stage planet carrier will be inevitably damaged, and the winch cannot be used normally.

In addition, the brake unit in the winch is to brake the intermediate transmission shaft and friction ring. During the braking, the drum is pulled by the twisted rope, the rotating drum drives the intermediate transmission shaft to rotate through the deceleration component, and the intermediate transmission shaft brakes through the brake unit and friction ring. During the braking, due to the friction between the rectangular spring and the friction ring in the brake unit, the rectangular spring is prone to heat by friction and fails.

The present invention designs a winch to solve the above problems.

SUMMARY

In order to solve the shortcomings of the prior art, the present invention discloses a winch, which is achieved by the following technical solutions.

In the present invention, it should be noted that, the terms "interior", "lower", "upper" and others indicating the orientation or positional relationship are based on the orientation or positional relationship shown in the drawings, or the customary orientation or positional relationship of the product herein, which is only for describing the present invention and simplifying the description, but not indicate or imply that the device or element referred to must have a specific orientation, or must be configured or operated in a specific orientation, therefore, it cannot be understood as limiting the present invention. In addition, the terms "first", "second", etc. are only used for distinguishing, but cannot be understood as indicating or implying relative importance.

A winch, comprising: a housing, an electric control module mounted in the upper side of the housing, a motor module mounted in the left end side of the housing and a deceleration module and a clutch mounted in the right end side of the housing, and a drum mounted in the middle of the lower side of the housing, the motor in the motor module drives the transmission shaft in the drum to rotate through a brake unit, the transmission shaft drives the drum to rotate through the deceleration module, and the clutch controls the axial movement of the transmission shaft; wherein the deceleration module is composed of a one-stage deceleration assembly, a two-stage deceleration assembly and a three-stage deceleration assembly; a sliding gear ring is slidably mounted in a two-stage planet carrier in the two-stage deceleration assembly, and the external teeth of the sliding gear ring are always in engagement with internal teeth in the two-stage planet carrier; one end of a spring C located in the two-stage planet carrier is connected to the sliding gear ring, and the other end is connected to the inner ring of the center hole of the two-stage planet carrier; a three-stage sun gear in the three-stage deceleration assembly mates with a convex wear ring on the side of the sliding gear ring; the three-stage sun gear always follows the transmission shaft for synchronous axial movement; the size of any one of external teeth on the three-stage sun gear is smaller than the spacing between any two adjacent internal teeth of the two-stage planet carrier.

The brake unit comprises a coupling A, a coupling B, a rectangular spring, a gear wheel, and a gear rack, wherein a convex column A is disposed on the side of disk A of the coupling A, and two arc blocks A are symmetrically disposed on the outer cylindrical surface of the convex column A; a convex column B is disposed on one side of disk B of the coupling B, and two arc blocks B are symmetrically disposed on the other side; one end of the transmission shaft is slidably mounted in the chute B of the convex column B; spring A is mounted between the groove surface of the chute B and the corresponding end surface of the transmission shaft is always in a compressed state; a circular cavity is disposed in the disk B, and two chutes A are symmetrically provided in the center on the inner ring surface of the circular cavity; two arc blocks B are sleeved on the convex column A, and the two arc blocks B mate with two arc blocks A respectively; one end of a rotary shaft is fixedly connected to the end of the convex column A away from the disk A, and the other end penetrates into the circular cavity of the disk B and is fixedly equipped with a gear wheel; two gear racks engaged with the gear wheel slide on the two chutes A, respectively; the ends of two gear racks away from each other are slidably mounted with a sliding block through a spring B; one end of a rectangular spring sleeved on the arc block A and the arc block B is connected with an arc block A, and the other end is connected with an arc block B;

A bracket is disposed in the housing and a friction ring is disposed at the center of the side of the bracket, the friction ring is located in the drum; the coupling A and the coupling B are both located in the friction ring; two tooth sockets are provided symmetrically in the center of the inner ring surface at one end of the friction ring; two sliding blocks on the two gear racks mate with the two tooth sockets respectively; the rectangular spring mates with the friction ring.

Preferably, the transmission shaft is provided with a ring groove A and a ring groove B; a snap ring A and a snap ring B are mounted in the ring groove A and ring groove B of the transmission shaft respectively; a convex ring is disposed on the side of the snap ring A and the convex ring is sleeved on the transmission shaft; the outer ring surface of the convex ring is mounted with a thrust bearing; the three-stage sun gear is sleeved on the transmission shaft and the three-stage sun gear is located between the thrust bearing and the snap ring B; one side of the three-stage sun gear is in contact with the thrust bearing, and the other side is in contact with the snap ring B.

Preferably, one of the two arc blocks A has a notch A; and one of the two arc blocks B has a notch B; the notch A is located oppositely to the notch B; one end of the rectangular spring is fixedly mounted in the notch A of the arc block A, and the other end is fixedly mounted in the notch B of the arc block B. The design of mounting at both ends of notch A, notch B and rectangular spring is that, the two ends of the rectangular spring are connected to the arc block A and the arc block B respectively when the rectangular spring is compressed, to achieve better bearing capacity; in addition, notch A and notch B can accommodate the ends of the rectangular spring, which facilitates the fitting of the arc block A and corresponding arc block B.

Preferably, two guide grooves are provided symmetrically inside the chute B of the convex column B; two guide blocks are disposed symmetrically on the outer wall at one end of the transmission shaft in the chute B; the two guide blocks slide in the two guide grooves respectively. The design of the guide blocks and guide grooves makes the spring A always in a compressed state and prevents one end of the transmission shaft from separating from coupling B.

Preferably, the chute B of the convex column B is internal regular hexagonal, the outer wall of the transmission shaft is external regular hexagonal, and the outer wall of the transmission shaft and the inner wall of the chute B are surface-to-surface sliding. By this way, it facilitates the convex column B of coupling B to drive the transmission shaft to rotate.

Preferably, two guide rails are mounted symmetrically in the center of inner ring surface of the circular cavity in the disk B; the two guide rails are in communication with the two chutes A respectively; the two gear racks slide on the two guide rails respectively. The design of the guide rail stabilizes the movement of the gear rack and prevents the gear rack from shifting during movement.

Preferably, a telescopic groove is provided at one end of the gear rack; the sliding block is slidably mounted in the telescopic groove; one end of the spring B located in the telescopic groove is connected to the telescopic groove surface, and the other end is connected to the sliding block.

Preferably, the outer wall of the rectangular spring is a friction surface; one end of the tooth socket is a straight groove face, and the other end is an arc groove face; the end of the sliding block away from the spring B is a cambered surface, to facilitate the sliding block to slide smoothly in the corresponding tooth socket.

Preferably, the clutch is composed of a clutch handle, a clutch sleeve and a clutch slider; the outer side of the housing is rotatably mounted with a clutch handle, and the clutch sleeve located in the housing is fixedly connected with the clutch handle; two spiral structures are symmetrically disposed on the clutch sleeve; the clutch slider is slidably mounted in the housing along the axial direction of the transmission shaft, the two spiral structures on the clutch sleeve mate with the clutch slider such that the clutch slider moves axially; the axial movement of clutch slider is controlled by rotating the clutch handle to drive the clutch sleeve to rotate. In the present invention, refer to the prior art for the specific mounting of the clutch handle, clutch sleeve and clutch slider.

Compared to the conventional winch, the present invention can achieve the following beneficial effects.

1. The innovative improvement of the structure of the engagement between the three-stage sun gear and the two-stage planet carrier increases the distance between the adjacent internal teeth of the two-stage planet carrier, which ensures that the three-stage sun gear can be smoothly inserted into the two-stage planet carrier even if the elasticity of spring A is reduced, such that the engagement width between the three-stage sun gear and the two-stage planet carrier can reach the normal requirements. With the design of sliding gear ring and spring C, it can greatly reduce the phenomenon of mis-engagement when the external teeth of the three-stage sun gear enter the internal teeth spacing of the two-stage planet carrier, protect the teeth integrity of the three-stage sun gear and the two-stage planet carrier, and extend the service life.

2. By improving the structure, the brake unit herein can achieve better braking effect than a transmission brake unit. Even if the friction failure occurs after the rectangular spring is used for a long time, the present invention can realize the complete braking of coupling B and friction ring by sliding the gear rack and sliding block into the tooth socket in the friction ring, thereby the indirect braking between the transmission shaft and the drum can be realized, ensuring that the winch still plays a role of limit protection for the drum after power failure during the working process.

Notes: 1, housing; 2, motor module; 3, drum; 4, clutch; 5, transmission shaft; 6, one-stage deceleration assembly; 7, two-stage deceleration assembly; 8, three-stage deceleration assembly; 9, brake unit; 10, motor; 12, rotary shaft; 13, gear wheel; 14, coupling A; 15, bracket; 16, friction ring; 17, rectangular spring; 18, coupling B; 19, spring A; 20, two-stage planet carrier; 21, three-stage sun gear; 22, sliding gear ring; 23, snap ring A; 24, snap ring B; 25, clutch handle; 26, clutch sleeve; 27, clutch slider; 28, gear rack; 29, tooth socket; 30, sliding block; 31, spring B; 32, guide rail; 33, chute A; 34, telescopic groove; 35, disk A; 36, convex column A; 37, arc block A; 38, notch A; 39, disk B; 40, convex column B; 41, arc block B; 42, notch B; 43, circular cavity; 44, guide groove; 45, guide block; 46, two-stage planetary gear; 47, three-stage planetary gear; 48, thrust bearing; 49, inner ring; 50, spring C; 51, electronic control module; 52, ring groove A; 53, ring groove B; 54, convex ring; 55, convex wear ring; 56, chute B.

DETAILED DESCRIPTION

The present invention will be described with reference to the accompanying drawings; however, it should be understood that the structural proportions in the accompanying drawings are only exemplary, and are not intended to limit the scope of the present disclosure.

Figure 1:
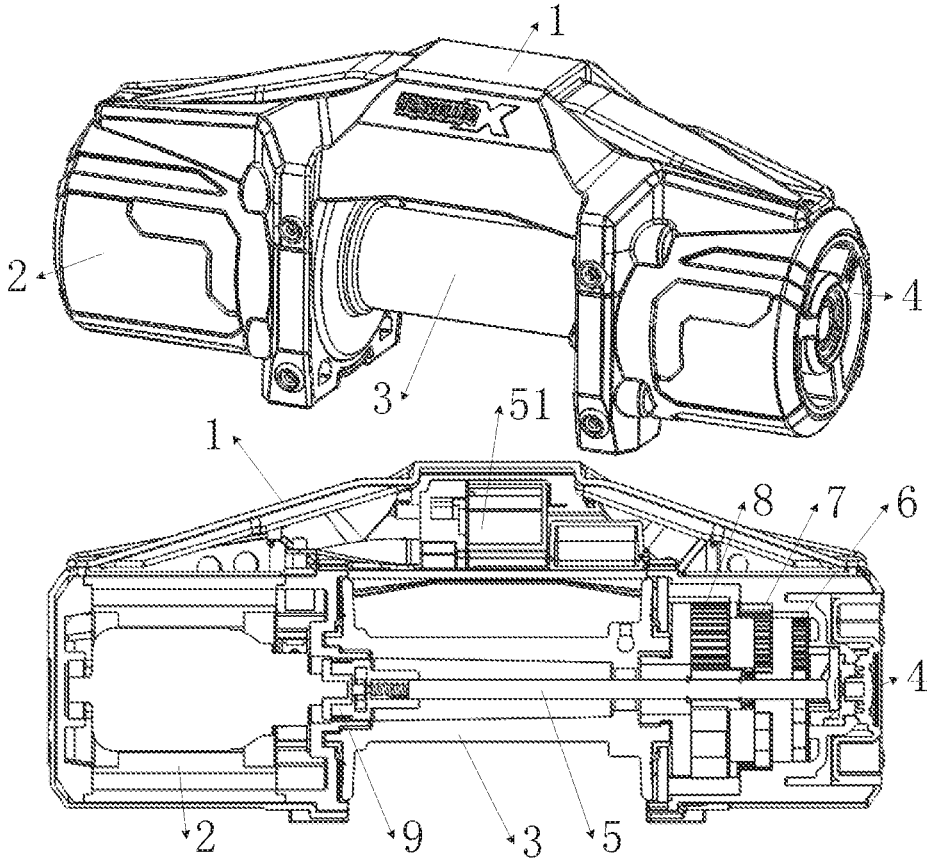
FIG. 1 is an overall and cross-sectional view of a winch.
Figure 3:
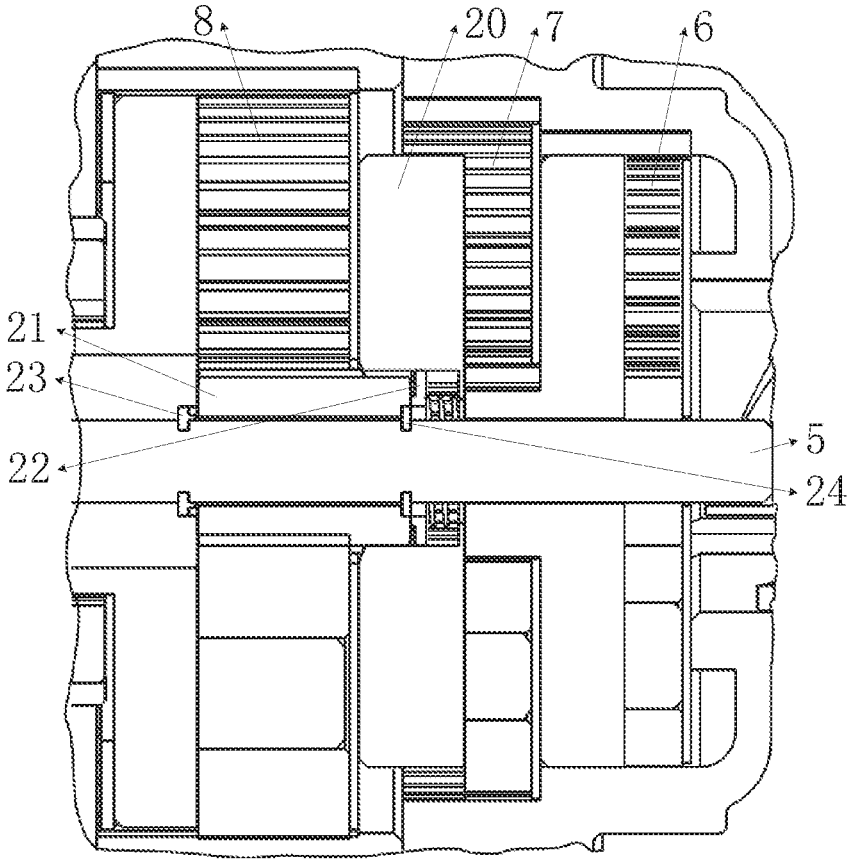
FIG. 3 is a partial enlarged view (II) of FIG. 1.
Figure 12:
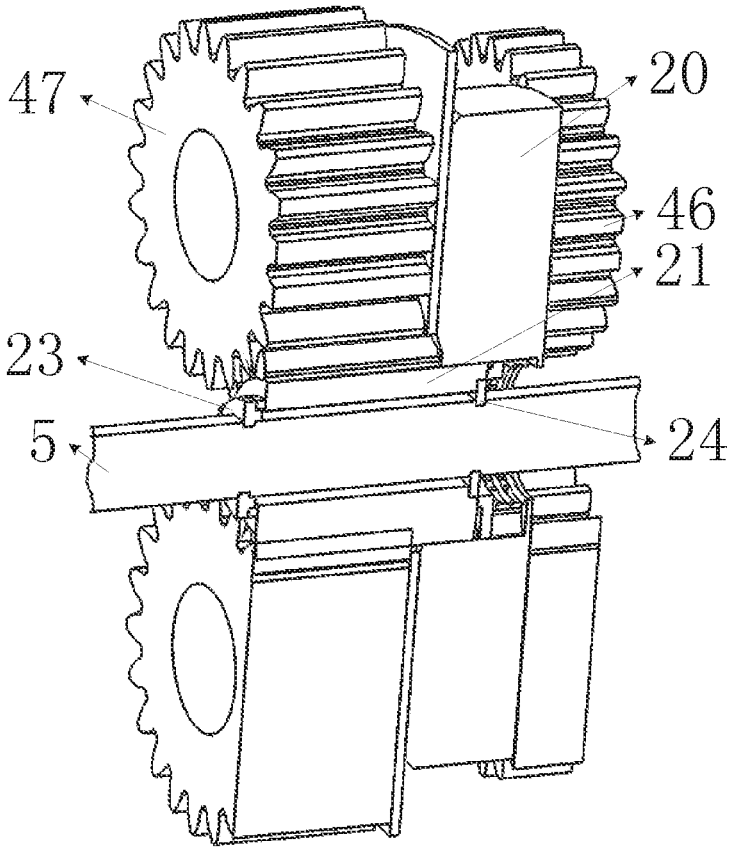
FIG. 12 is a cross-sectional view showing mating between a three-stage sun gear and a two-stage planet carrier.
Figure 13:
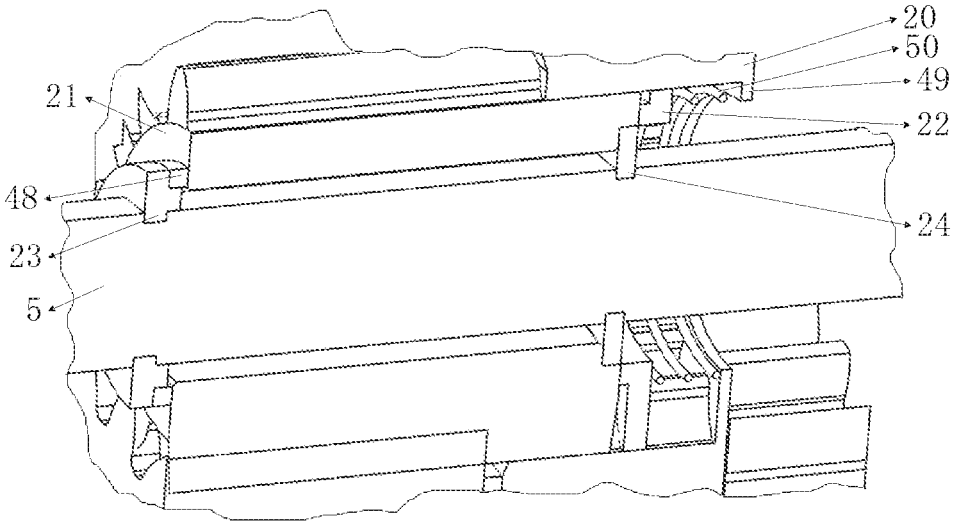
FIG. 13 is a partial enlarged view of FIG. 12.
Figure 14:
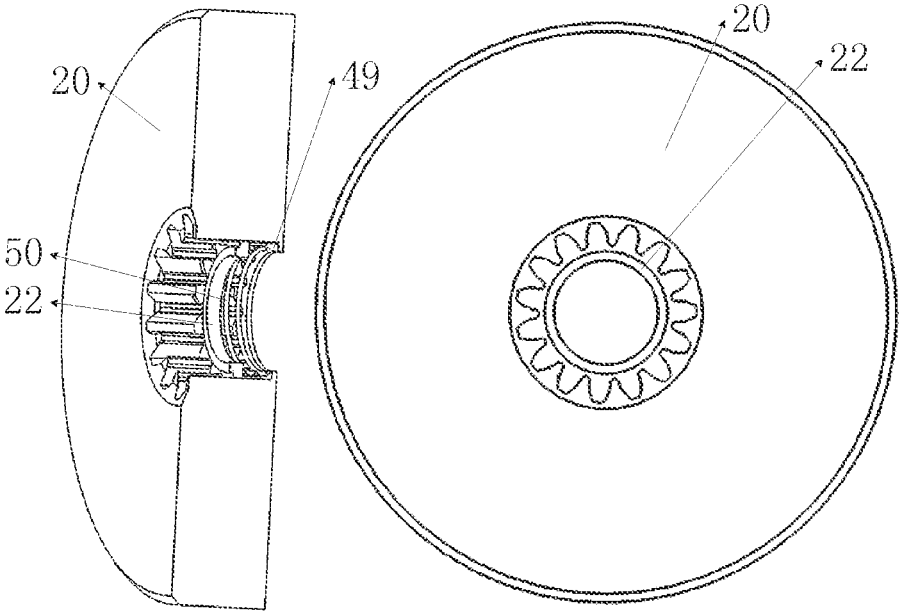
FIG. 14 is the mounting cross-sectional view and mounting front view of a sliding gear ring.
Figure 16:
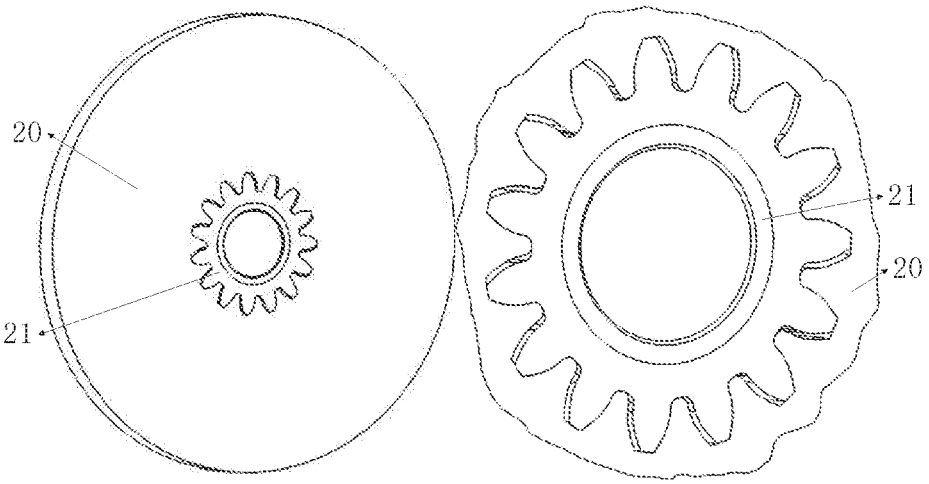
FIG. 16 is a view showing engagement of a three-stage sun gear and a two-stage planet carrier and a partial enlarged view thereof.

As shown in FIG. 1, a winch, comprising: a housing 1, an electric control module 51 mounted in the upper side of the housing 1, a motor module 2 mounted in the left end side of the housing and a deceleration module and a clutch 4 mounted in the right end side of the housing 1, and a drum 3 mounted in the middle of the lower side of the housing 1, the motor 10 in the motor module 2 drives the transmission shaft 5 in the drum 3 to rotate through a brake unit 9, the transmission shaft 5 drives the drum 3 to rotate through the deceleration module, and the clutch 4 controls the axial movement of the transmission shaft 5; as shown in FIG. 3, the deceleration module is composed of a one-stage deceleration assembly 6, a two-stage deceleration assembly 7 and a three-stage deceleration assembly 8; as shown in FIGS. 12, 13 and 14, a sliding gear ring 22 is slidably mounted in a two-stage planet carrier 20 in the two-stage deceleration assembly 7, and the external teeth of the sliding gear ring 22 are always in engagement with internal teeth in the two-stage planet carrier 20; One end of a spring C 50 located in the two-stage planet carrier 20 is connected to the sliding gear ring 22, and the other end is connected to the inner ring 49 of the center hole of the two-stage planet carrier 20; a three-stage sun gear 21 in the three-stage deceleration assembly 8 mates with a convex wear ring 55 on the side of the sliding gear ring 22; the three-stage sun gear 21 always follows the transmission shaft 5 for synchronous axial movement; as shown in FIG. 16, the size of any one of external teeth on the three-stage sun gear 21 is smaller than the spacing between any two adjacent internal teeth of the two-stage planet carrier 20.

Figure 2:
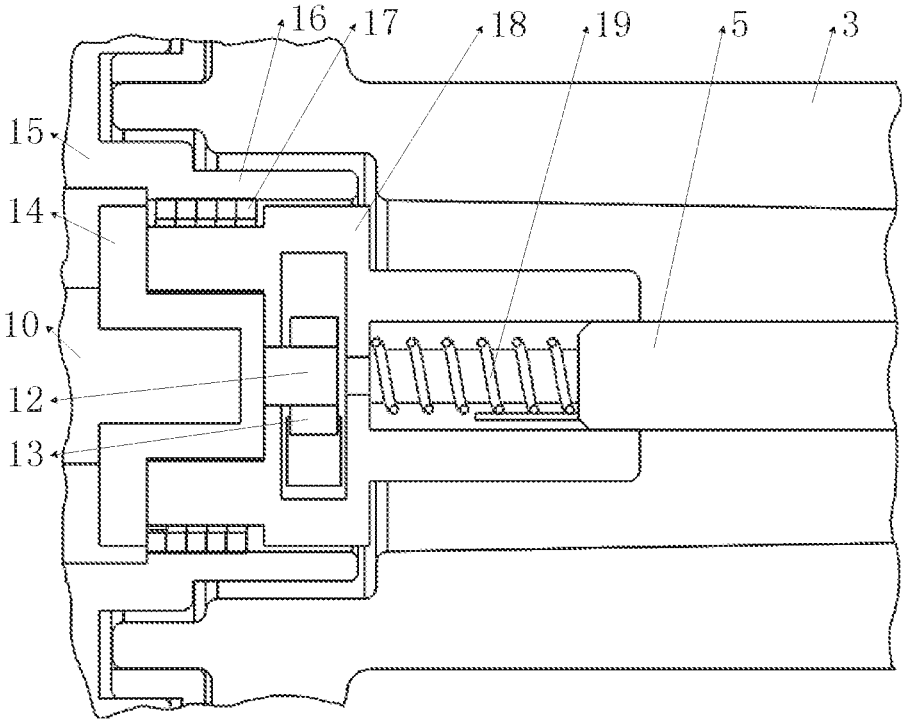
FIG. 2 is a partial enlarged view (I) of FIG. 1.
Figure 8:
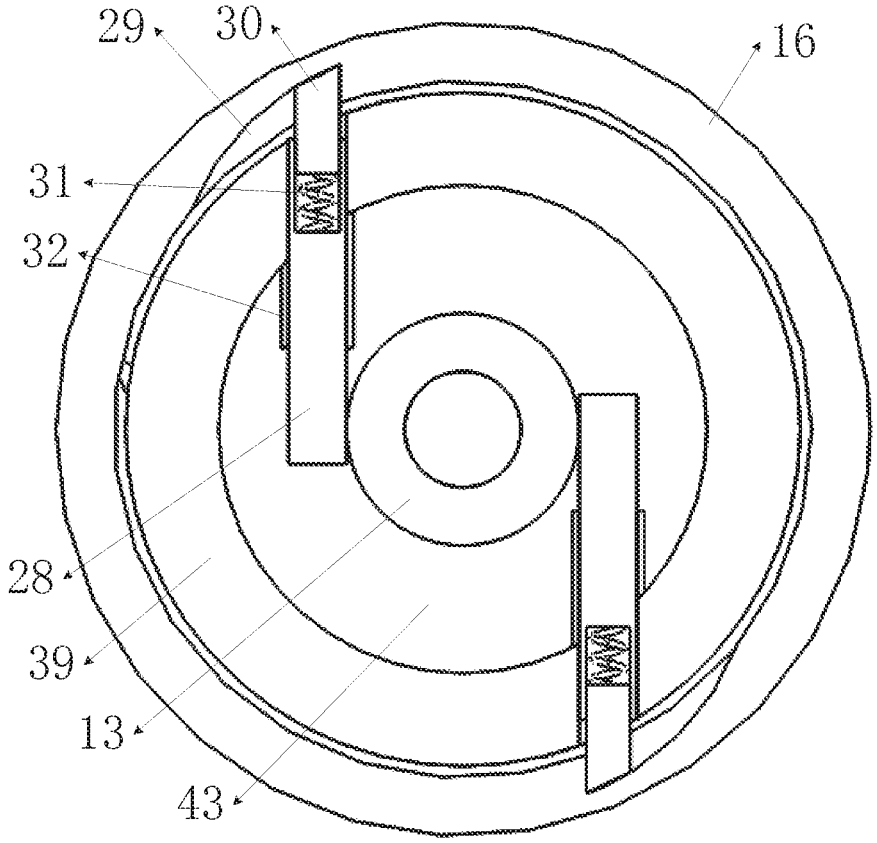
FIG. 8 is a partial enlarged front view of FIG. 7.
Figure 9:
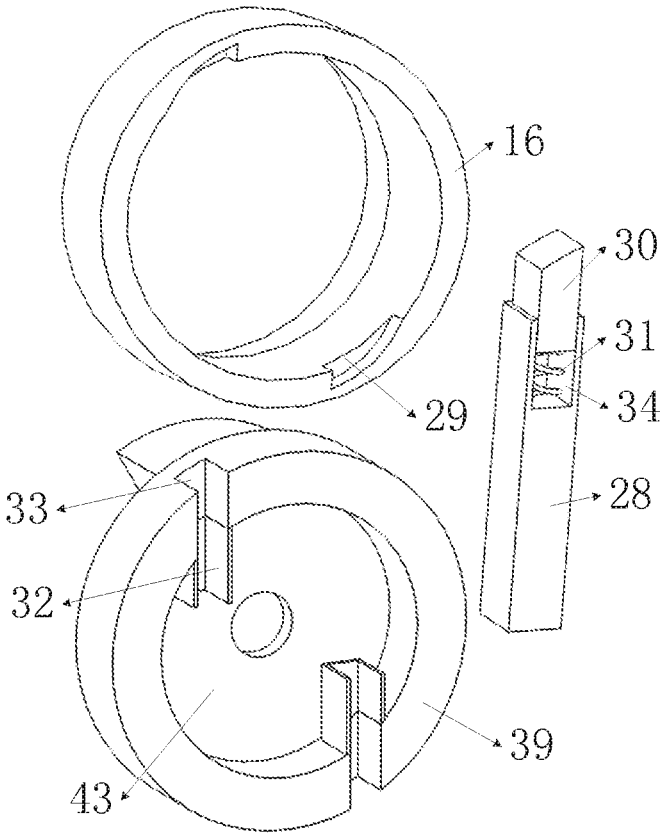
FIG. 9 is a cross-sectional view of a friction ring, a disk B and a gear rack.
Figure 10:
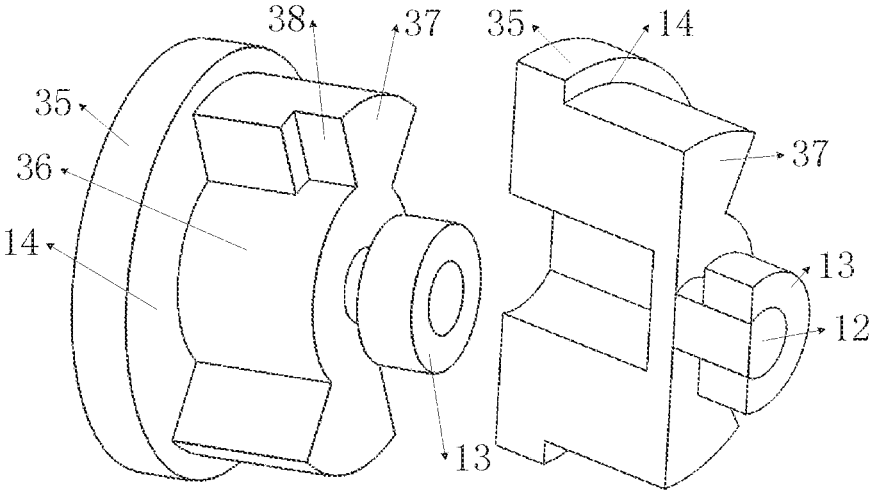
FIG. 10 is a structural view of a coupling A.
Figure 11:
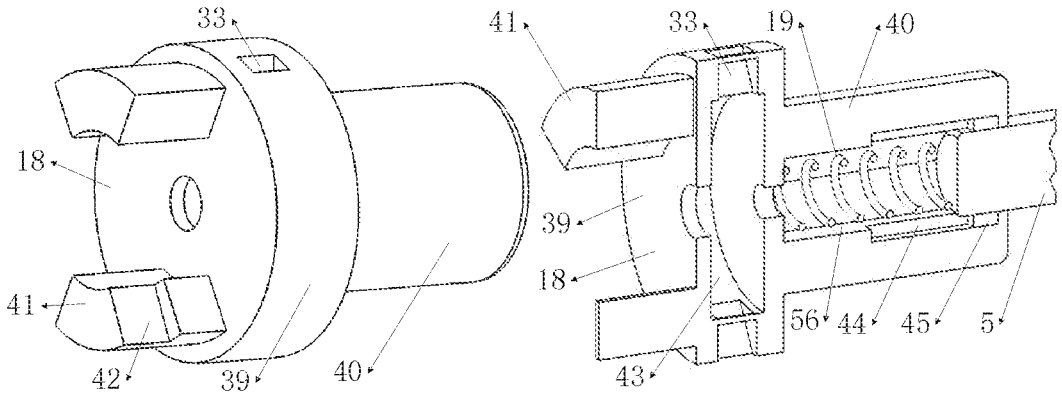
FIG. 11 is a structural view of a coupling B.
Figure 17:
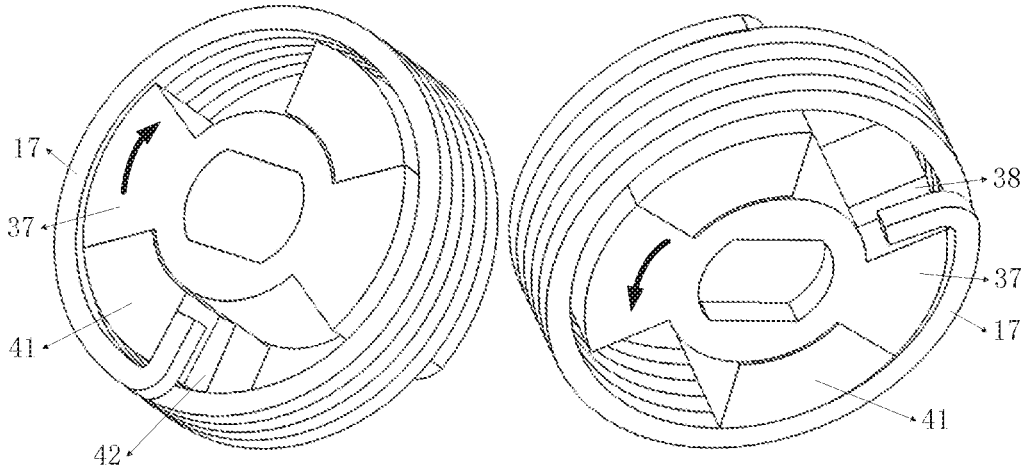
FIG. 17 is a mounting view of a rectangular spring.

The brake unit 9 comprises a coupling A 14, a coupling B 18, a rectangular spring 17, a gear wheel 13, and a gear rack 28, as shown in FIG. 10, wherein a convex column A 36 is disposed on the side of disk A 35 of the coupling A 14, and two arc blocks A 37 are symmetrically disposed on the outer cylindrical surface of the convex column A 36; as shown in FIG. 11, a convex column B 40 is disposed on one side of disk B 39 of the coupling B 18, and two arc blocks B 41 are symmetrically disposed on the other side; one end of the transmission shaft 5 is slidably mounted in the chute B 56 of the convex column B 40; a spring A 19 is mounted between the groove surface of the chute B 56 and the corresponding end surface of the transmission shaft 5 is always in a compressed state; as shown in FIGS. 9 and 11, a circular cavity 43 is disposed in the disk B 39, and two chutes A 33 are symmetrically provided in the center on the inner ring surface of the circular cavity 43; as shown in FIG. 17, two arc blocks B 41 are sleeved on the convex column A 36, and the two arc blocks B 41 mate with two arc blocks A 37 respectively; as shown in FIGS. 2 and 8, one end of a rotary shaft 12 is fixedly connected to the end of the convex column A 36 away from the disk A 35, and the other end penetrates into the circular cavity 43 of the disk B 39 and is fixedly equipped with a gear wheel 13; two gear racks 28 engaged with the gear wheel 13 slide on the two chutes A 33, respectively; the ends of two gear racks 28 away from each other are slidably mounted with a sliding block 30 through a spring B 31; as shown in FIG. 17, one end of a rectangular spring 17 sleeved on the arc block A 37 and the arc block B 41 is connected with an arc block A 37, and the other end is connected with an arc block B 41.

Figure 6:
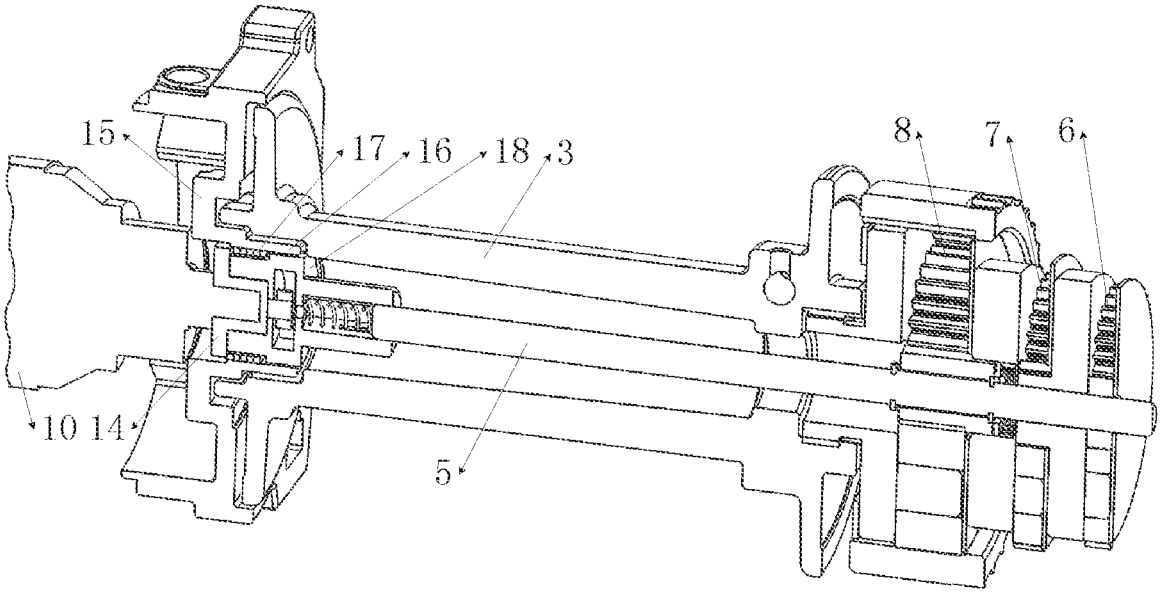
FIG. 6 is a cross-sectional view of an internal transmission structure of winch.
Figure 7:
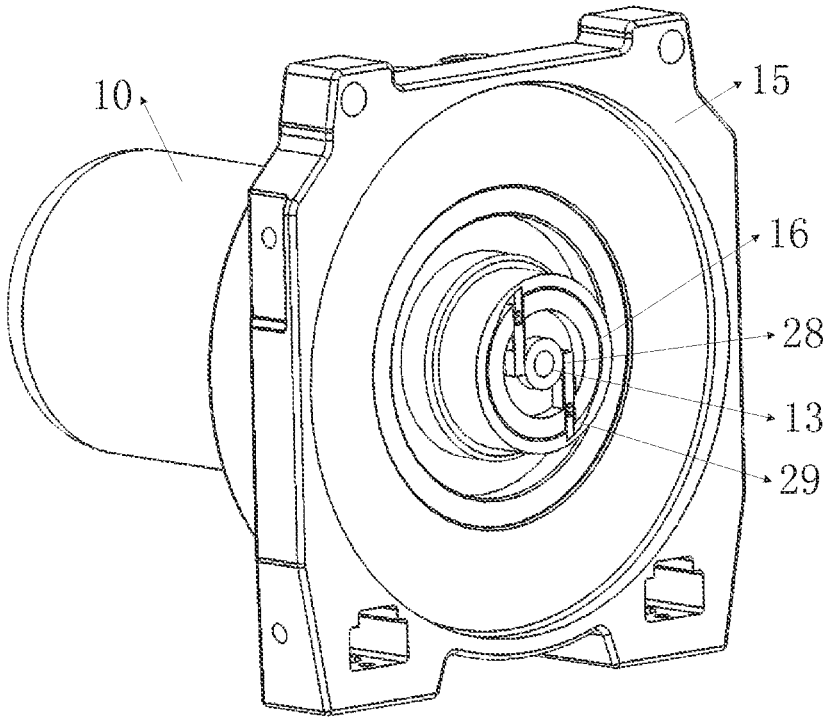
FIG. 7 is a cross-sectional view showing the mating between a gear rack and a gear wheel.

As shown in FIGS. 6 and 7, a bracket 15 is disposed in the housing 1 and a friction ring 16 is disposed at the center of the side of the bracket 15, the friction ring 16 is located in the drum 3; the coupling A 14 and the coupling B 18 are both located in the friction ring 16; as shown in FIGS. 8 and 9, two tooth sockets 29 are provided symmetrically in the center of the inner ring surface at one end of the friction ring 16; two sliding blocks 30 on the two gear racks 28 mate with the two tooth sockets 29 respectively; as shown in FIGS. 2 and 6, the rectangular spring 17 mates with the friction ring 16.

Figure 15:
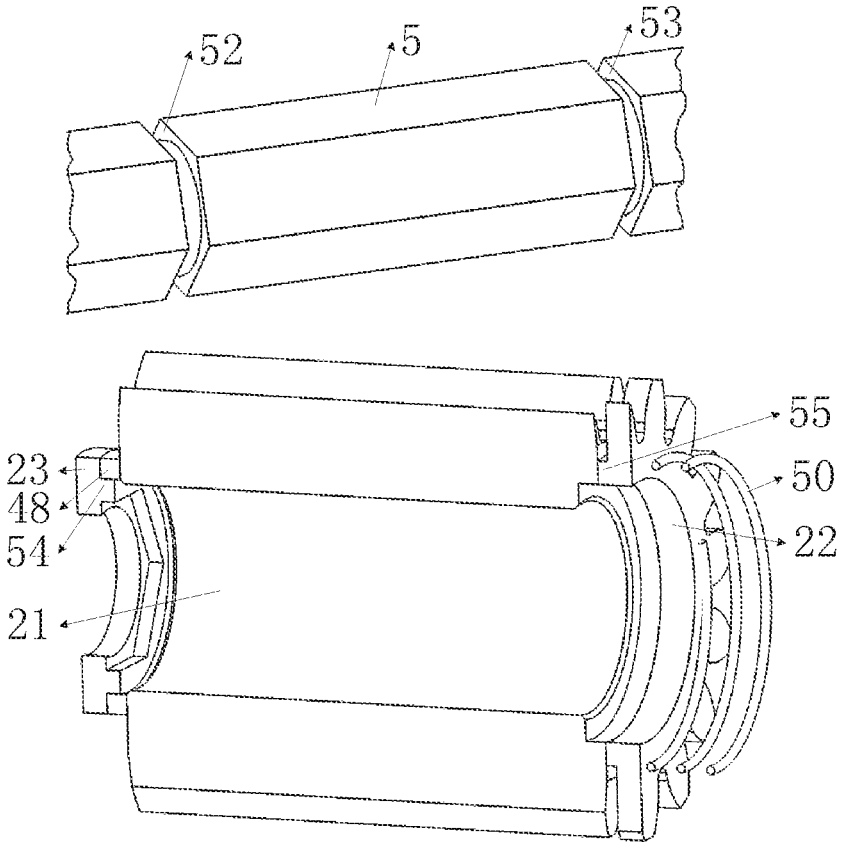
FIG. 15 is a partial view of a transmission shaft and a cross-sectional view of a three-stage sun gear.

As shown in FIGS. 13 and 15, the transmission shaft 5 is provided with a ring groove A 52 and a ring groove B 53; a snap ring A 23 and a snap ring B 24 are mounted in the ring groove A 52 and ring groove B 53 of the transmission shaft 5 respectively; a convex ring 54 is disposed on the side of the snap ring A 23 and the convex ring 54 is sleeved on the transmission shaft 5; the outer ring surface of the convex ring 54 is mounted with a thrust bearing 48; the three-stage sun gear 21 is sleeved on the transmission shaft 5 and the three-stage sun gear 21 is located between the thrust bearing 48 and the snap ring B 24; one side of the three-stage sun gear 21 is in contact with the thrust bearing 48, and the other side is in contact with the snap ring B 24.

As shown in FIGS. 10, 11 and 17, one of the two arc blocks A 37 has a notch A 38; and one of the two arc blocks B 41 has a notch B 42; the notch A 38 is located oppositely to the notch B 42; one end of the rectangular spring 17 is fixedly mounted in the notch A 38 of the arc block A 37, and the other end is fixedly mounted in the notch B 42 of the arc block B 41.

As shown in FIG. 11, two guide grooves 44 are provided symmetrically inside the chute B 56 of the convex column B 40; two guide blocks 45 are disposed symmetrically on the outer wall at one end of the transmission shaft 5 in the chute B 56; the two guide blocks 45 slide in the two guide grooves 44 respectively.

The chute B 56 of the convex column B 40 is internal regular hexagonal, the outer wall of the transmission shaft 5 is external regular hexagonal, and the outer wall of the transmission shaft 5 and the inner wall of the chute B 56 are surface-to-surface sliding.

As shown in FIGS. 8 and 9, two guide rails 32 are mounted symmetrically in the center of inner ring surface of the circular cavity 43 in the disk B 39; the two guide rails 32 are in communication with the two chutes A 33 respectively; the two gear racks 28 slide on the two guide rails 32 respectively.

As shown in FIG. 9, a telescopic groove 34 is provided at one end of the gear rack 28; the sliding block 30 is slidably mounted in the telescopic groove 34; one end of the spring B 31 located in the telescopic groove 34 is connected to the telescopic groove 34 surface, and the other end is connected to the sliding block 30.

The outer wall of the rectangular spring 17 is a friction surface; one end of the tooth socket 29 is a straight groove face, and the other end is an arc groove face; the end of the sliding block 30 away from the spring B 31 is a cambered surface.

Figure 4:
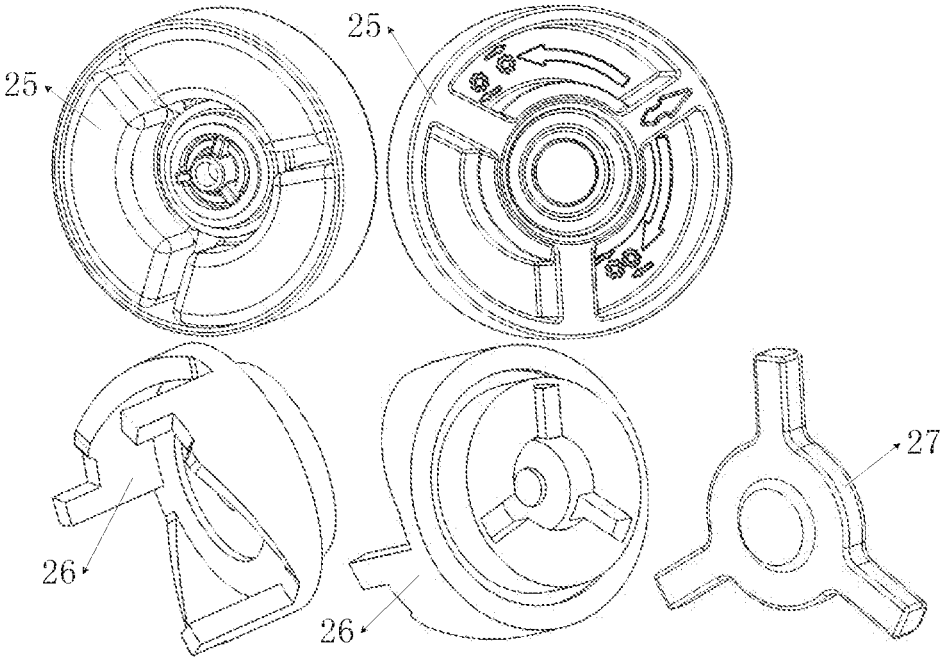
FIG. 4 is a view of a clutch part.
Figure 5:
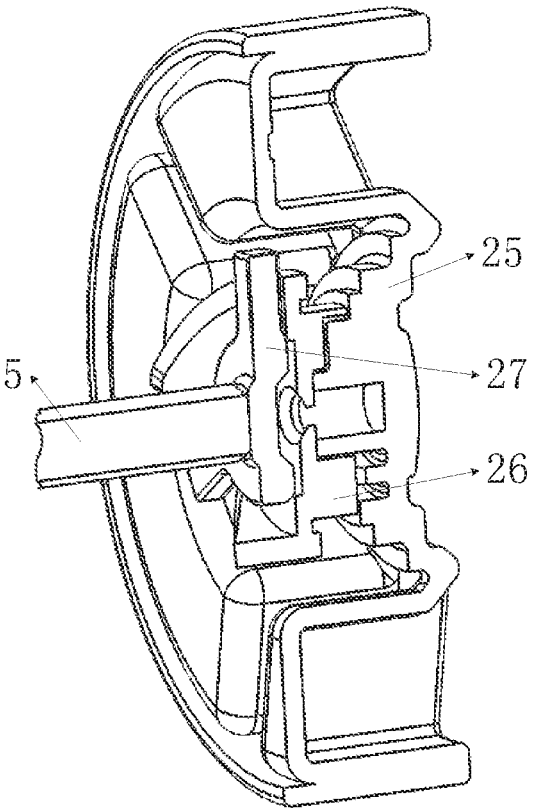
FIG. 5 is a cross-sectional view of clutch.

As shown in FIGS. 4 and 5, the clutch 4 is composed of a clutch handle 25, a clutch sleeve 26 and a clutch slider 27; the outer side of the housing 1 is rotatably mounted with a clutch handle 25, and the clutch sleeve 26 located in the housing 1 is fixedly connected with the clutch handle 25; two spiral structures are symmetrically disposed on the clutch sleeve 26; the clutch slider 27 is slidably mounted in the housing 1 along the axial direction of the transmission shaft 5, the two spiral structures on the clutch sleeve 26 mate with the clutch slider 27 such that the clutch slider 27 moves axially; the axial movement of clutch slider 27 is controlled by rotating the clutch handle 25 to drive the clutch sleeve 26 to rotate.

The sliding of the sliding block 30 of the present invention in the telescopic groove 34 of the gear rack 28 can be mounted in a mating manner between the guide block 45 and the guide groove 44, to ensure that the gear rack 28 can pull the sliding block 30 to follow the gear rack 28 to synchronize movement through the guide block 45 when moving in a direction away from the corresponding tooth socket 29.

In the present invention, the thrust bearing 48 is mounted on the convex ring 54 of the snap ring A23. It can achieve the following function:

The function of the snap ring A23 is to push the three-stage sun gear 21 through the thrust bearing 48. During the three-stage sun gear 21 is pushed, the three-stage sun gear 21 can be smoothly rotated under the action of the thrust bearing 48, so that the three-stage sun gear 21 will not cause frictional obstacles with the snap ring A23.

In the present invention, a one-stage deceleration assembly 6 is composed of a one-stage sun gear, a one-stage planetary gear, a one-stage planet carrier and a one-stage gear ring; a two-stage deceleration assembly 7 is composed of a two-stage sun gear, a two-stage planetary gear 46, a two-stage planet carrier 20 and a two-stage gear ring; a three-stage deceleration assembly 8 is composed of a three-stage sun gear 21, a three-stage planetary gear 47, a three-stage planet carrier and a three-stage gear ring; the transmission shaft 5 drives the two-stage deceleration assembly 7 to move through the one-stage deceleration assembly 6, the two-stage planet carrier 20 in the two-stage deceleration assembly 7 is transmissibly mated with the three-stage sun gear 21 in the three-stage deceleration assembly 8, and the three-stage deceleration assembly 8 is transmissibly connected with the drum 3.

In the present invention, the snap ring B 24 and the three-stage sun gear 21 are in sliding friction fit.

In the present invention, the spacing between internal teeth of the two-stage planet carrier 20 is reasonably designed while ensuring the strength of the internal teeth.

In the present invention, the rectangular spring 17 has the following roles: firstly, the rectangular spring 17 and the friction ring 16 can produce a friction braking effect; secondly, the deformation of the rectangular spring 17 can effectively buffer the impact between the arc block A 37 and the arc block B 41, playing a protective role.

The specific working process of the present invention is described as follows. In the initial state when the winch is not in use, the three-stage sun gear 21 engages with the two-stage planet carrier 20, the spring C50 is in a compressed state, and the convex wear ring 55 on the sliding gear ring 22 is in frictional contact with the side of the three-stage sun gear 21; the spring A 19 is in a compressed state, and the guide block 45 is located at one end of the guide groove 44 away from the disk B39; the outer diameter of the rectangular spring 17 reaches the maximum and the outer diameter of the rectangular spring 17 is in friction braking with the inner ring surface of the friction ring 16; the side of the arc block A 37 fits the side of the arc block B 41. In this state, the drum 3 on the winch cannot release the twisted rope. The gear rack 28 is located in the corresponding guide rail 32 and chute A 33; the sliding block 30 on the gear rack 28 is located in the corresponding tooth socket 29 and fits the straight groove face of the corresponding tooth socket 29; or the sliding block 30 on the gear rack 28 is in contact with the inner ring surface of the friction ring 16, the sliding block 30 does not enter the corresponding tooth socket 29, and the spring B 31 is in a compressed state. In the following description, the sliding block 30 located in the corresponding tooth socket 29 is used as a reference example.

When the winch needs to release the twisted rope, the clutch handle 25 is manually rotated, the clutch handle 25 pushes the clutch slider 27 to move towards the drum 3 through the clutch sleeve 26, the clutch slider 27 pushes the transmission shaft 5 to move towards the motor 10. The transmission shaft 5 pushes the three-stage sun gear 21 to move synchronously through the snap ring B24 and the snap ring A 23 in a clamping manner, and the three-stage sun gear 21 is disengaged from the two-stage planet carrier 20. When the transmission shaft 5 is pushed to the limit position, the force of the clutch handle 25 is removed, and the position of the clutch slider 27 remains unchanged. During the synchronous movement of the transmission shaft 5 and the three-stage sun gear 21, under the reset action of spring C 50, the sliding gear ring 22 moves to reset towards the three-stage sun gear 21, and the sliding gear ring 22 will never be detached from the two-stage planet carrier 20 during the reset process. Under the pushing of the transmission shaft 5, the spring A19 continues to be compressed, and the guide block 45 follows the transmission shaft 5 to move in the guide groove 44. Since the three-stage sun gear 21 is not engaged with the two-stage planet carrier 20 any longer, the power transmission between the transmission shaft 5 and drum 3 will no longer exist, and the transmission shaft 5 will still restrict the rotation of the one-stage deceleration assembly 6 and the two-stage deceleration assembly 7. The rotation restriction of the three-stage deceleration assembly 8 and the two-stage deceleration assembly 7 is removed, thereby the rotation of the drum 3 is not indirectly restricted by the transmission shaft 5 any longer; by this way, the twisted rope on the winch can be released.

When it is necessary to re-wind the released twist rope on drum 3, the clutch handle 25 is reversely rotated to make the clutch sleeve 26 to rotate reversely. During the process, under the reset action of spring A 19, the transmission shaft 5 pushes the clutch slider 27 to move to reset along the guided cambered surface rail. The transmission shaft 5 pushes the three-stage sun gear 21 to move synchronously through snap ring B 24 and snap ring A 23 in a clamping manner; when the external teeth of three-stage sun gear 21 are exactly opposite to the spacing of internal teeth of the two-stage planet carrier 20, the external teeth of the three-stage sun gear 21 can quickly and smoothly insert into the spacing of the internal teeth of the two-stage planet carrier 20 to achieve the engagement between them. The three-stage sun gear 21 pushes the sliding gear ring 22 to move, and the spring C 50 is compressed again; when the transmission shaft 5 drives the guide block 45 to move to the end of the guide groove 44 away from the disk B 39, the transmission shaft 5 will not continue to move any longer, at this time, the width of engagement between the three-stage sun gear 21 and the two-stage planet carrier 20 reaches the normal requirements. When the twisted rope is manually pulled in this state, since the three-stage sun gear 21 is engaged with the two-stage planet carrier 20, the indirect braking relationship occurs again between the drum 3 and the transmission shaft 5. When the drum 3 is not rotated, it represents the three-stage sun gear 21 has been engaged with the two-stage planet carrier 20. When the external teeth of the three-stage sun gear 21 are not opposite to the spacing of the internal teeth of the two-stage planet carrier 20, the twisted rope is pulled to make the drum 3 rotate at a certain angle, drum 3 drives the three-stage deceleration assembly 8 to make the three-stage sun gear 21 rotate at a certain angle, during the rotation, the external teeth of the three-stage sun gear 21 will be exactly opposite to the spacing of the internal teeth of the two-stage planet carrier 20. In such case, the process of inserting the three-stage sun gear 21 into the two-stage planet carrier 20 and generating the engagement is carried out repeatedly.

When a user forgets to pull the twisted rope and the external teeth of the three-stage sun gear 21 are not opposite to the spacing of the internal teeth of the two-stage planet carrier 20, the side of the three-stage sun gear 21 fits the side of the two-stage planet carrier 20, and the user starts the motor 10. The motor 10 axis drives the coupling A 14, the rotary shaft 12 and the gear wheel 13 to rotate; the gear wheel 13 drives the two gear racks 28 to move, and the two gear racks 28 move in opposite directions. The gear rack 28 pulls the sliding block 30 to follow the gear rack 28 to move synchronously by mounting the spring B 31 or the traditional guide groove 44 and guide block 45, the sliding block 30 separates from the corresponding tooth socket 29, the friction ring 16 and disk B 39 are no longer connected as a whole, and the braking of the coupling B 18 and friction ring 16 is released; as shown in FIG. 17, the arc block A 37 on coupling A 14 moves towards another arc block B 41 until it has a toggle fit with the arc block B 41. During the process, the rectangular spring 17 is compressed, and the outer diameter of the rectangular spring 17 becomes smaller, such that the rectangular spring 17 does not generate friction braking with the friction ring 16 any longer. When the arc block A 37 toggles the arc block B 41 to rotate, the coupling A 14 and the coupling B 18 rotate synchronously, and the gear wheel 13 and the gear rack 28 will also rotate synchronously. The gear wheel 13 will not drive the gear rack 28 to continue to move along the guide rail 32; in this state, braking will not occur between the rectangular spring 17 or the coupling B 18 and the friction ring 16, and the coupling A 14 drives the transmission shaft 5 to rotate via the coupling B18.

The transmission shaft 5 drives the two-stage deceleration assembly 7 to rotate through the one-stage deceleration assembly 6, and rotate the two-stage planet carrier 20 in the two-stage deceleration assembly 7; when the external teeth of the three-stage sun gear 21 are opposite to the spacing of the internal teeth of the two-stage planet carrier 20, under the reset action of spring A 19, the transmission shaft 5 pushes the three-stage sun gear 21 to insert into the spacing of the internal teeth of the two-stage planet carrier 20 through the snap ring B 24 and snap ring A 23 in a clamping manner. During the process, the side of the three-stage sun gear 21 and the convex wear ring 55 on the sliding gear ring 22 are always in frictional contact. Under the action of friction, the sliding gear ring 22 can make the three-stage sun gear 21 to rotate, such that the three-stage sun gear 21 can quickly change from the original non-rotating state to the rotated state, and the speed relative to the two-stage planet carrier becomes small, to reduce the impact, so that the three-stage sun gear 21 can be smoothly inserted into the two-stage planet carrier 20.

As shown in FIG. 16, in the present invention, the spacing between internal teeth of the two-stage planet carrier 20 should be designed to be greater than the size of external teeth of the three-stage sun gear 21 for the following reasons: firstly, it is to allow the external teeth of the three-stage sun gear 21 to have sufficient time to insert into the spacing of the internal teeth of the two-stage planet carrier 20 smoothly; secondly, in the process of inserting the three-stage sun gear 21 into the two-stage planet carrier 20, in the rotation driving direction of the two-stage planet carrier 20, the three-stage sun gear 21 obtains the speed, and its speed relative to the two-stage planet carrier 20 is reduced, so the toggle tooth surface in the rotation drive direction of internal teeth of the two-stage planet carrier 20 needs some time to toggle the toggled teeth surface in the external teeth rotation drive direction of the three-stage sun gear 21, during the period, the non-toggle teeth surface in the external teeth rotation drive direction of the three-stage sun gear 21 has a very small friction with the non-toggle teeth surface in the internal teeth rotation drive direction of the two-stage planet carrier 20, which is very convenient for the three-stage sun gear 21 to insert into the two-stage planet carrier 20 rapidly and smoothly.

When the transmission shaft 5 drives the guide block 45 to move to the end of the guide groove 44 away from the disk B39, the transmission shaft 5 does not continue to move. At this time, the width of engagement between the three-stage sun gear 21 and the two-stage planet carrier 20 meets the normal requirements, and the sliding gear ring 22 restores to the initial position. As the two-stage planet carrier 20 continues to rotate and drive, the two-stage planet carrier 20 drives the three-stage sun gear 21 to rotate synchronously; the two-stage deceleration assembly 7 is transmissibly connected with the three-stage deceleration assembly 8, and the drum 3 can rotate and wind the twisted rope.

When the winch is stopped according to actual needs, the motor 10 is powered off. Under the reset force of the rectangular spring 17, the coupling A 14 will be rotated in the opposite direction relative to the coupling B 18, and the arc block A 37 on the coupling A 14 will move towards the arc block B 41 on the coupling B 18 in the initial state until the side of the arc block A 37 fits the side of the arc block B 41 to restore to the original state. The outer diameter of the rectangular spring 17 is restored to the maximum in the initial state, and a friction braking occurs between the outer diameter of the rectangular spring 17 and the inner ring surface of the friction ring 16. During the reverse rotation of the coupling A 14, the coupling A 14 makes gear wheel 13 to rotate reversely, and the gear wheel 13 drives the two gear racks 28 to move toward the initial position, and the two gear racks 28 move oppositely. The sliding block 30 on the two gear racks 28 are slidably mated with the inner ring surface of the friction ring 16, and the spring B 31 is in a compressed state; the sliding block 30 slides along the inner ring surface of the friction ring 16 into the corresponding tooth socket 29. After the gear rack 28 connects the friction ring 16 with the coupling B 18 as a whole, under the obstacles of the gear rack 28, sliding block 30 and tooth socket 29, braking will occur on the friction ring 16 and coupling B18 in the direction in which the drum 3 releases the twisted rope.

Although the present invention is described in conjunction with the foregoing embodiments, it is not limited to the foregoing embodiments, but limited by the appended claims. A person of ordinary skill in the art can easily perform modifications and changes to them without departing from the essential concept and scope of the present invention.

What is claimed is:

1. A winch, comprising: a housing, an electric control module mounted in the upper side of the housing, a motor module mounted in the left end side of the housing and a deceleration module and a clutch mounted in the right end side of the housing, and a drum mounted in the middle of the lower side of the housing, wherein the motor in the motor module drives a transmission shaft in the drum to rotate through a brake unit, the transmission shaft drives the drum to rotate through the deceleration module, and the clutch controls the axial movement of the transmission shaft; wherein the deceleration module is composed of a one-stage deceleration assembly, a two-stage deceleration assembly and a three-stage deceleration assembly; a sliding gear ring is slidably mounted in a two-stage planet carrier in the two-stage deceleration assembly, and the external teeth of the sliding gear ring are always in engagement with internal teeth in the two-stage planet carrier; one end of a spring C located in the two-stage planet carrier is connected to the sliding gear ring, and the other end is connected to the inner ring of the center hole of the two-stage planet carrier; a three-stage sun gear in the three-stage deceleration assembly mates with a convex wear ring on the side of the sliding gear ring; the three-stage sun gear always follows the transmission shaft for synchronous axial movement; the size of any one of external teeth on the three-stage sun gear is smaller than the spacing between any two adjacent internal teeth of the two-stage planet carrier;

the brake unit comprises a coupling A, a coupling B, a rectangular spring, a gear wheel, and a gear rack, wherein a convex column A is disposed on the side of disk A of the coupling A, and two arc blocks A are symmetrically disposed on the outer cylindrical surface of the convex column A; a convex column B is disposed on one side of disk B of the coupling B, and two arc blocks B are symmetrically disposed on the other side; one end of the transmission shaft is slidably mounted in a chute B of the convex column B; spring A is mounted between the groove surface of the chute B and the corresponding end surface of the transmission shaft is always in a compressed state; a circular cavity is disposed in the disk B, and two chutes A are symmetrically provided in the center on the inner ring surface of the circular cavity; two arc blocks B are sleeved on the convex column A, and the two arc blocks B mate with two arc blocks A respectively; one end of a rotary shaft is fixedly connected to the end of the convex column A away from the disk A, and the other end penetrates into the circular cavity of the disk B and is fixedly equipped with a gear wheel; two gear racks engaged with the gear wheel slide on the two chutes A, respectively; the ends of two gear racks away from each other are slidably mounted with a sliding block through a spring B; one end of the rectangular spring sleeved on the arc block A and the arc block B is connected with an arc block A, and the other end is connected with an arc block B;

a bracket is disposed in the housing and a friction ring is disposed at the center of the side of the bracket, the friction ring is located in the drum; the coupling A and the coupling B are both located in the friction ring; two tooth sockets are provided symmetrically in the center of the inner ring surface at one end of the friction ring; two sliding blocks on the two gear racks mate with the two tooth sockets respectively; the rectangular spring mates with the friction ring.

2. The winch according to claim 1, wherein the transmission shaft is provided with a ring groove A and a ring groove B; a snap ring A and a snap ring B are mounted in the ring groove A and ring groove B of the transmission shaft respectively; a convex ring is disposed on the side of the snap ring A and the convex ring is sleeved on the transmission shaft; the outer ring surface of the convex ring is mounted with a thrust bearing; the three-stage sun gear is sleeved on the transmission shaft and the three-stage sun gear is located between the thrust bearing and the snap ring B; one side of the three-stage sun gear is in contact with the thrust bearing, and the other side is in contact with the snap ring B.

3. The winch according to claim 1, wherein one of the two arc blocks A has a notch A; and one of the two arc blocks B has a notch B; the notch A is located oppositely to the notch B; one end of the rectangular spring is fixedly mounted in the notch A of the arc block A, and the other end is fixedly mounted in the notch B of the arc block B.

4. The winch according to claim 1, wherein two guide grooves are provided symmetrically inside the chute B of the convex column B; two guide blocks are disposed symmetrically on the outer wall at one end of the transmission shaft in the chute B; the two guide blocks slide in the two guide grooves respectively.

5. The winch according to claim 1, wherein the chute B of the convex column B is internal regular hexagonal, the outer wall of the transmission shaft is external regular hexagonal, and the outer wall of the transmission shaft and the inner wall of the chute B are surface-to-surface sliding.

6. The winch according to claim 1, wherein two guide rails are mounted symmetrically in the center of inner ring surface of the circular cavity in the disk B; the two guide rails are in communication with the two chutes A respectively; the two gear racks slide on the two guide rails respectively.

7. The winch according to claim 1, wherein a telescopic groove is provided at one end of the gear rack; the sliding block is slidably mounted in the telescopic groove; one end of the spring B located in the telescopic groove is connected to the telescopic groove surface, and the other end is connected to the sliding block.

8. The winch according to claim 1, where the outer wall of the rectangular spring is a friction surface; one end of the tooth socket is a straight groove face, and the other end is an arc groove face; the end of the sliding block away from the spring B is a cambered surface.

9. The winch according to claim 1, wherein the clutch is composed of a clutch handle, a clutch sleeve and a clutch slider; the outer side of the housing is rotatably mounted with the clutch handle, and the clutch sleeve located in the housing is fixedly connected with the clutch handle; two spiral structures are symmetrically disposed on the clutch sleeve; the clutch slider is slidably mounted in the housing along the axial direction of the transmission shaft, the two spiral structures on the clutch sleeve mate with the clutch slider such that the clutch slider moves axially; the axial movement of clutch slider is controlled by rotating the clutch handle to drive the clutch sleeve to rotate.

* * * * *